US010220981B2

(12) United States Patent
Cheng

(10) Patent No.: US 10,220,981 B2
(45) Date of Patent: Mar. 5, 2019

(54) DRINKING WATER BUCKET

(71) Applicant: Shih-Fen Cheng, New Taipei (TW)

(72) Inventor: Shih-Fen Cheng, New Taipei (TW)

( * ) Notice: Subject to any disclaimer, the term of this patent is extended or adjusted under 35 U.S.C. 154(b) by 0 days.

(21) Appl. No.: 15/863,209

(22) Filed: Jan. 5, 2018

(65) Prior Publication Data

US 2018/0305084 A1 Oct. 25, 2018

(30) Foreign Application Priority Data

Apr. 25, 2017 (TW) ..... 106113713 A

(51) Int. Cl.
*B65D 25/24* (2006.01)
*B65D 47/20* (2006.01)

(52) U.S. Cl.
CPC ..... *B65D 25/24* (2013.01); *B65D 47/20* (2013.01)

(58) Field of Classification Search
CPC ..... B65D 25/24; B65D 47/20
USPC ..... 222/185.1, 180, 181.1–181.3, 146.1, 222/146.6, 129.1
See application file for complete search history.

(56) References Cited

U.S. PATENT DOCUMENTS 6,868,988 B2 * 3/2005 Ufheil ..... A47J 31/404 222/129.1
9,315,140 B2 * 4/2016 Orita ..... B60P 3/224
9,352,948 B2 * 5/2016 Orita ..... B67D 3/0009
2010/0116847 A1 * 5/2010 Foroughi ..... B67D 1/0004 222/81
2018/0306492 A1 * 10/2018 Nanos ..... F25D 31/002

* cited by examiner

*Primary Examiner* — Lien Ngo
(74) *Attorney, Agent, or Firm* — Muncy, Geissler, Olds & Lowe, P.C.

(57) ABSTRACT

A drinking water bucket comprises at least one base, at least one base plate and at least one bucket structure. The bucket structure comprises a bucket, a cover body and a pipe. The bucket comprises an accommodating space, a convex portion and an opening. The cover body comprises a through hole and a water outlet hole. The pipe penetrates through the through hole, and two ends of the pipe are respectively positioned in the accommodating space and in the air outside the cover body, such that when a user switches on the drinking water bucket and water in the bucket flows into a teacup, the sound caused by air flowing back to bubbles in water can be eliminated, and the water in the bucket can be allowed to flow evenly into the teacup.

10 Claims, 11 Drawing Sheets

DRINKING WATER BUCKET

FIELD OF THE INVENTION

The present invention relates to a drinking water bucket, and particularly relates to a water drinking bucket which eliminates sound and allows water to flow out evenly.

BACKGROUND OF THE INVENTION

The water drinking way at past is an artificial operating mode, i.e., a user fills water in a teapot and then puts the teapot on a heater, and after switching on the heater, the user needs to keep an eye on it and switches off the heater when water boils. As the user cannot leave, time is wasted, and also inconvenience is caused to the user.

With the advancement of science and technology, the technology of drinking water is no longer limited to the way in which water is boiled and someone needs to keep an eye on it as before. There has developed a water dispenser, a water boiler and other equipment in the prior art, and the internal technical features thereof can automatically heat water to produce drinking water which is then immediately drunk conveniently, as long as water is filled in the equipment.

However, when the existing drinking water bucket is switched on to allow water to flow into the teacup, people in the surrounding environment are affected by high volume and interference caused by air flowing back into the water. In addition, because air flows back into water through a water outlet hole, it prevents water flowing into the teacup, and water cannot flow out evenly. Therefore, it is necessary to improve the equipment.

SUMMARY OF THE INVENTION

An objective of the present invention is to provide a drinking water bucket, which eliminates the sound caused by bubbles and allows water in the bucket to flow out evenly through a pipe, wherein the pipe is disposed in an internal space of the buckle, and one end of the pipe extends to an outside space.

In accordance with said objective, the present invention provides a drinking water bucket. The drinking water bucket comprises at least one base, at least one base plate and at least one bucket structure. The base comprises a first transverse plate, a second transverse plate, a first longitudinal plate and a second longitudinal plate, wherein two opposite ends of the first longitudinal plate are connected to one end of the first transverse plate and one end of the second transverse plate, respectively. Further, one end of the first transverse plate, which is connected to the first longitudinal plate and one end of the second transverse plate, which is connected to the first longitudinal plate are located on the same side. Two opposite ends of the second longitudinal plate are respectively connected to the other end of the first transverse plate and the other end of the second transverse plate. Moreover, the other end of the first transverse plate, which is connected to the second longitudinal plate and the other end of the second transverse plate, which is connected to the second longitudinal plate are located on the same side.

Two opposite sides of the base plate are respectively connected to one side of the first longitudinal plate and one side of the second longitudinal plate, and the base plate is located between the first longitudinal plate and the second longitudinal plate, wherein the base plate comprises a placement hole which is formed in the base plate and penetrates through the base plate.

The bucket structure comprises a bucket, a cover body and a pipe, wherein the bucket comprises an accommodating space arranged inside the bucket, a convex portion which is disposed at one end of the bucket and extends into the placement hole, and an opening which is formed in one end of the convex portion and communicated with the accommodating space. The cover body covers the opening, and comprises a through hole which penetrates through the cover body, and a water outlet hole which penetrates through the cover body, adjoins to the through hole and is communicated with the accommodating space. The pipe extends into the through hole, wherein one end of the pipe is accommodated in the accommodating space, and the other end of the pipe is located outside of the cover body.

Further, at least one extension pipe is connected to one end of the pipe, which is located outside the cover body. The extension pipe is used for being connected to at least one of another pipe in another bucket structure.

Further, the drinking water bucket further comprises a water opening/closing valve which is disposed at the water outlet hole.

The present invention has the following characteristics.

1. Two ends of the pipe are respectively located in the accommodating space and in the air outside the cover body. Therefore, when a user opens the water opening/closing valve and water in the bucket flows into a teacup, the sound caused by bubbles generated from air flowing back into water can be eliminated to reduce the interference to people in the surrounding environment.

2. Also because two ends of the pipe are respectively located in the accommodating space and in the air outside the cover body, when a user opens the water opening/closing valve and water in the bucket flows into a teacup. Therefore, water in the bucket can flow into the teacup evenly, which is different from the prior art in which water flows out unevenly.

3. Due to the arrangement of the extension pipe, the user can increase another bucket structure or a plurality of bucket structures. Therefore, more drinkers may be dispersed to other bucket structures, rather than concentrating to the front of the same bucket structure to cause space congestion.

4. The through hole and the pipe are disposed beside the water outlet hole. Therefore, the space and the channel for air flows are increased, and the amount of air flowing to the water in the bucket from the water outlet hole is reduced. Therefore, not only the objective of this application is achieved, but also the technical features thereof can be further taken as teaching materials to teach people.

DETAILED DESCRIPTION OF THE PREFERRED EMBODIMENTS

Figure 1:
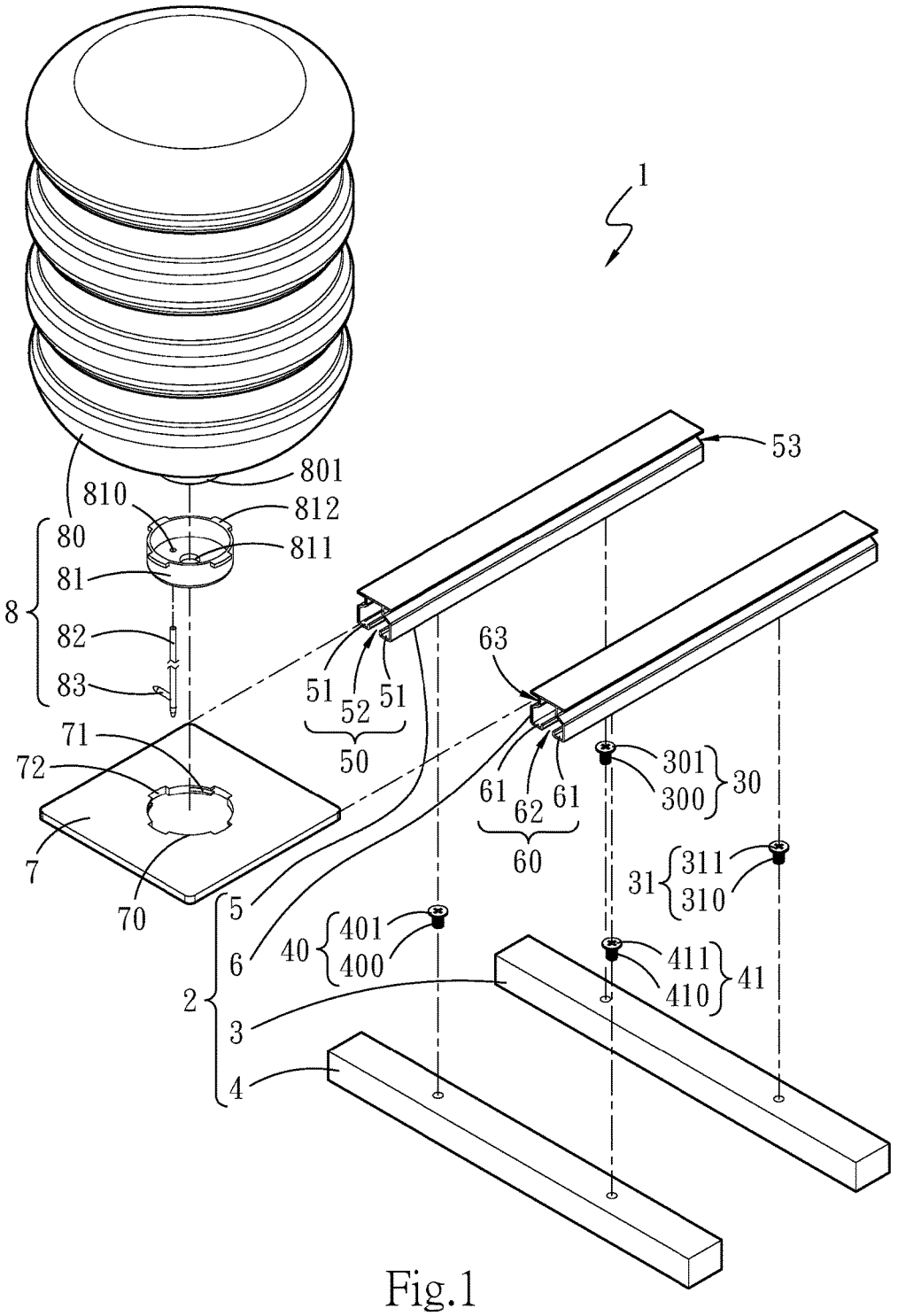
FIG. 1 is a perspective exploded view of a drinking water bucket of the present invention.
Figure 2:
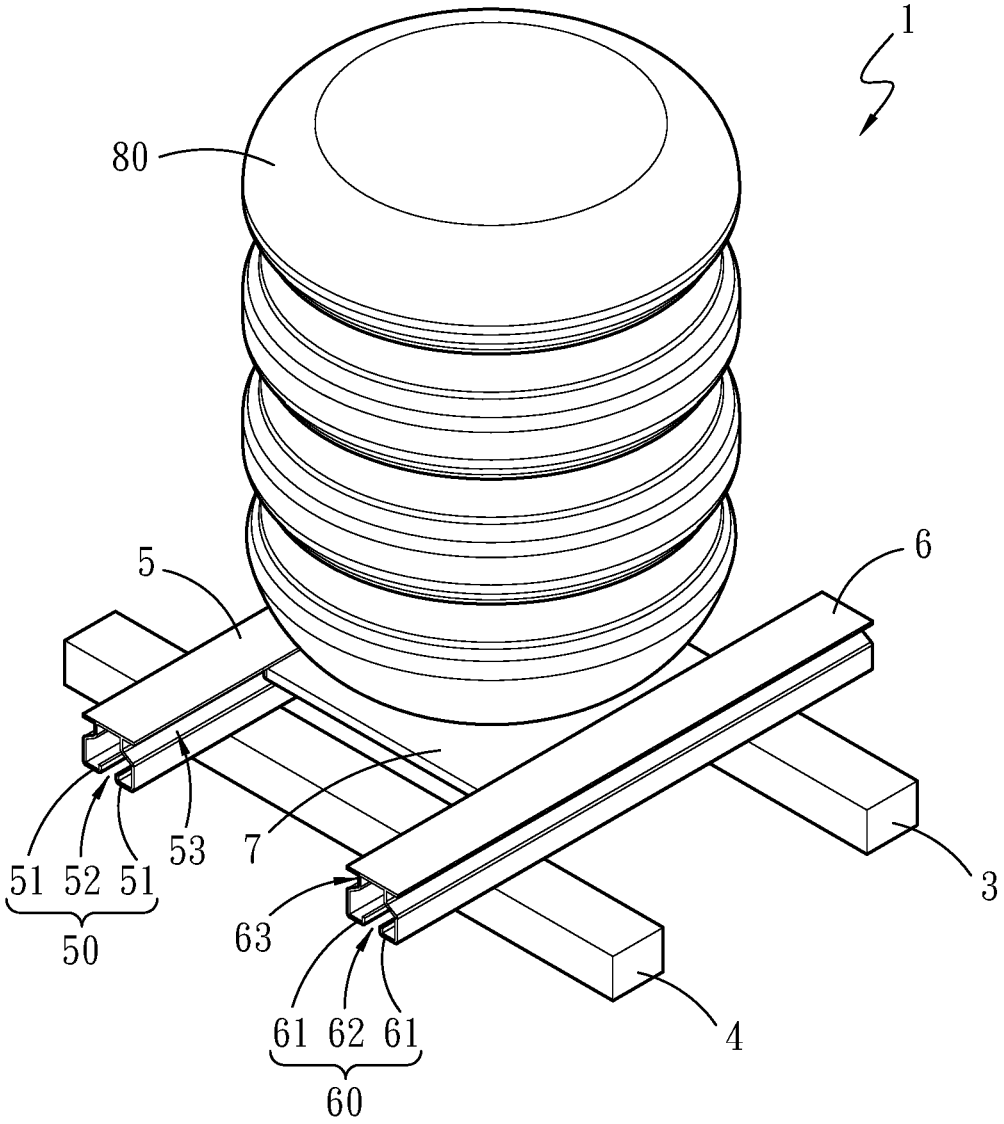
FIG. 2 is a perspective assembly view of FIG. 1.
Figure 3:
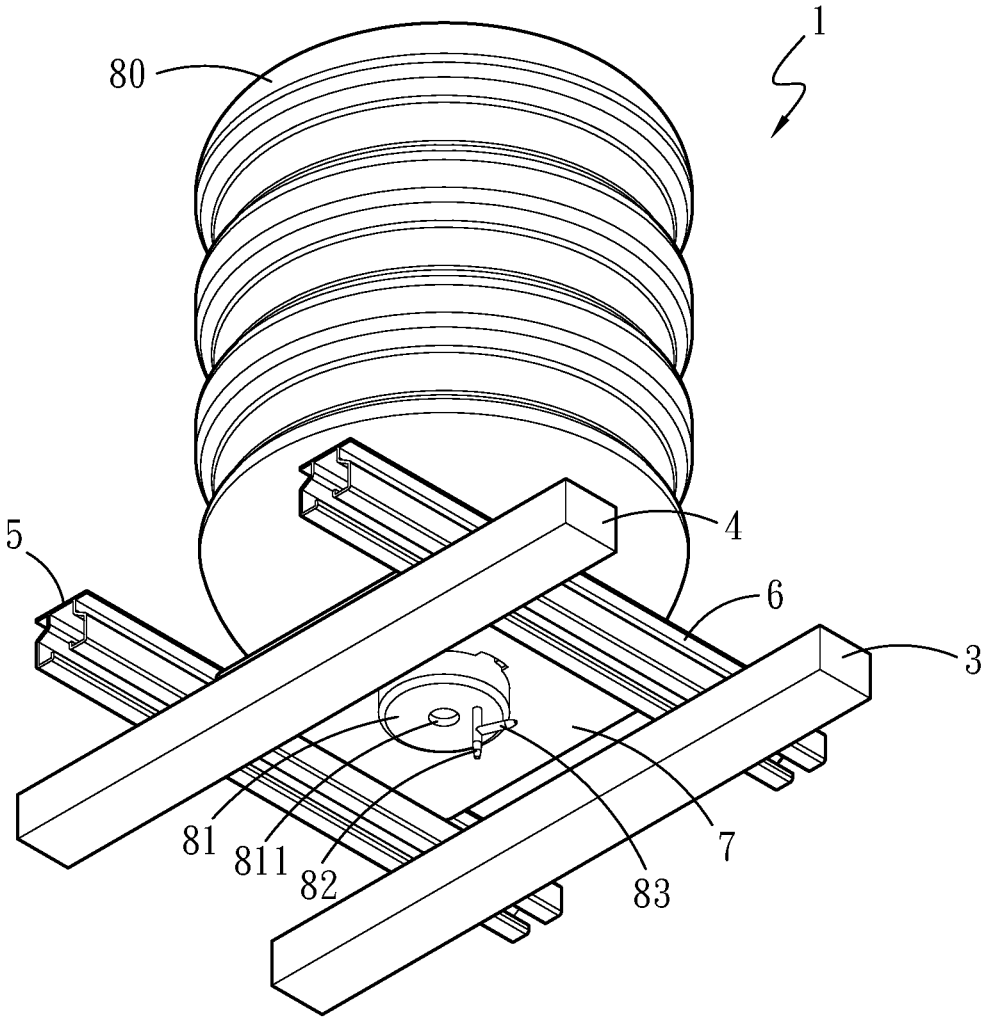
FIG. 3 is a top view of FIG. 2.
Figure 4:
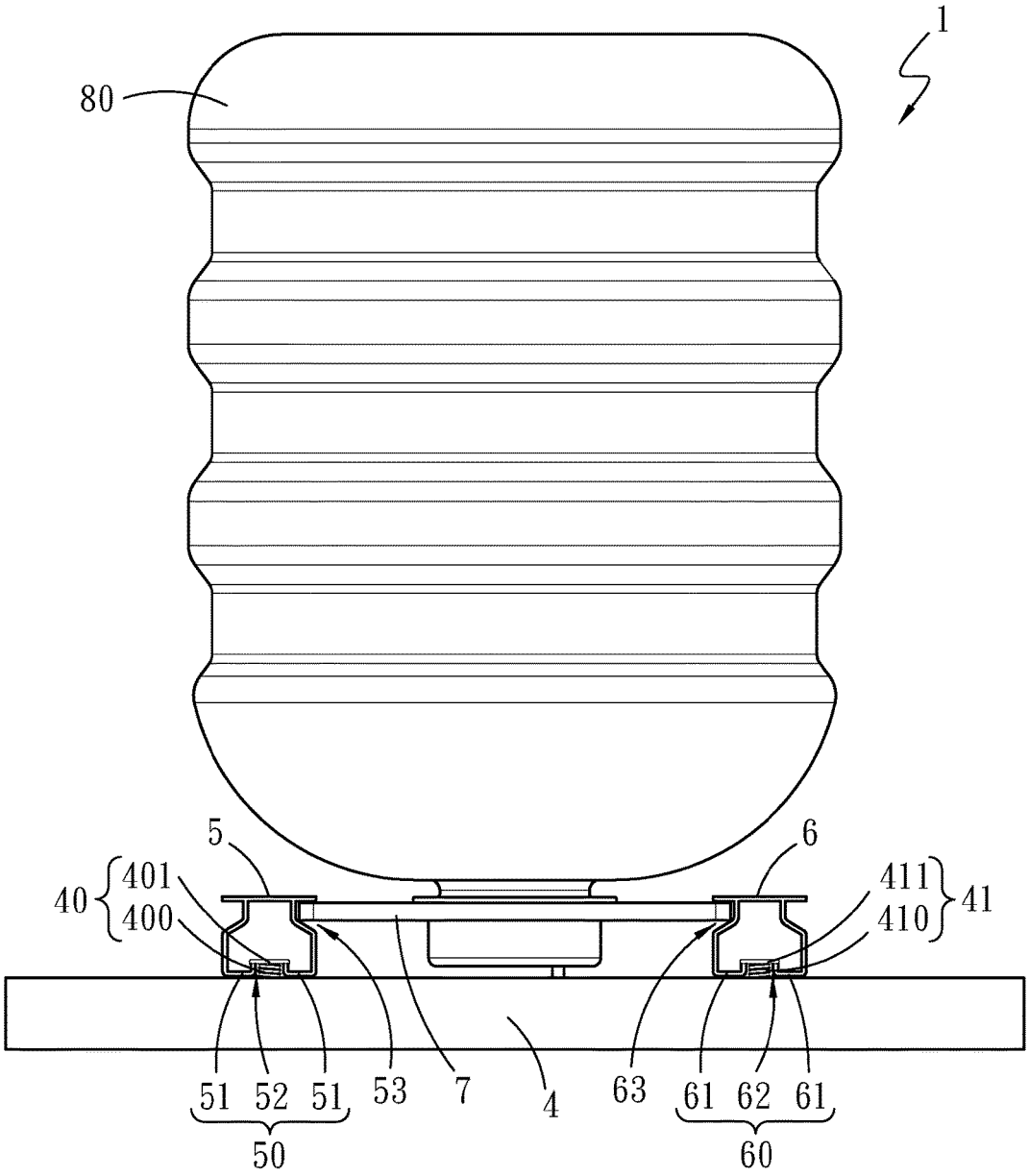
FIG. 4 is a planar view of FIG. 2.
Figure 5:
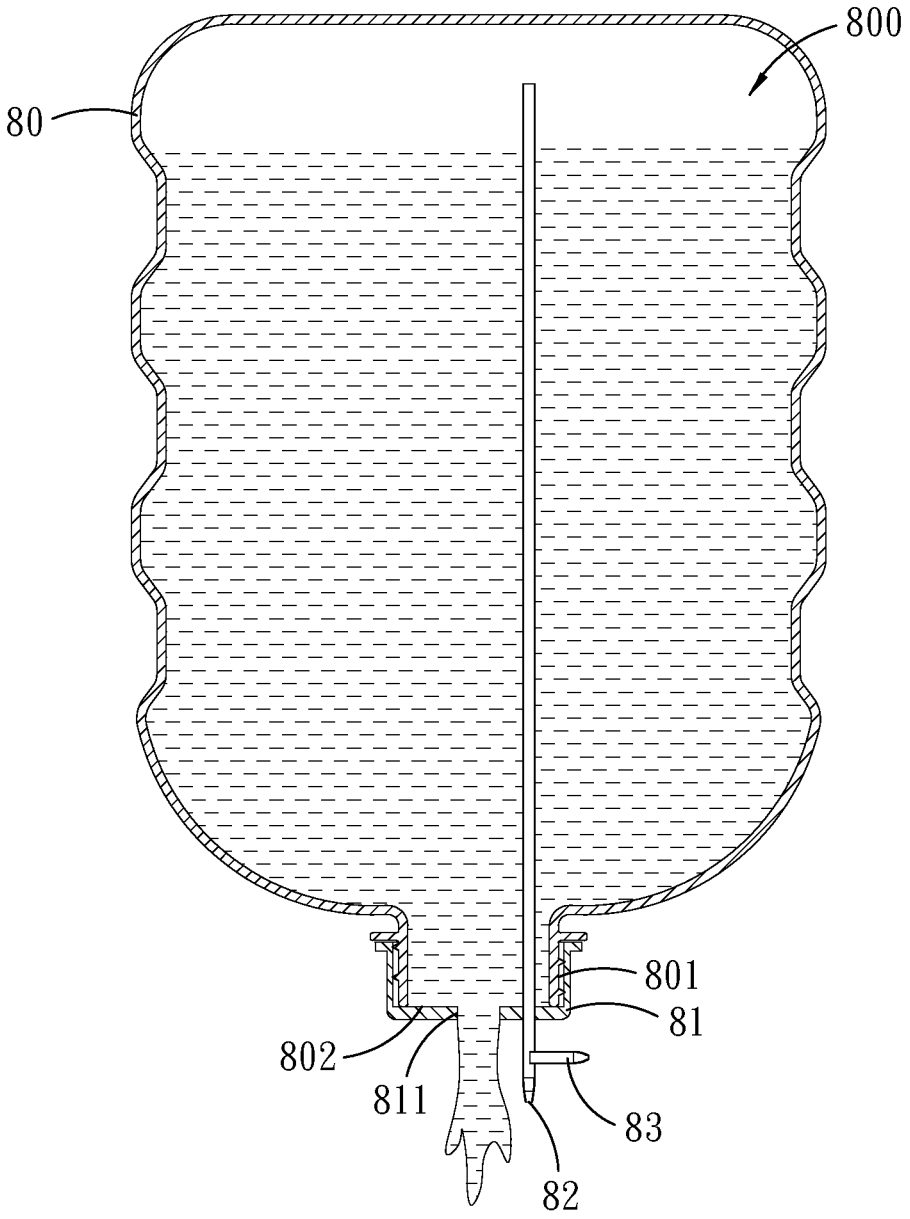
FIG. 5 is a sectional view of FIG. 2.

As shown in FIG. 1, FIG. 2, FIG. 3, FIG. 4 and FIG. 5, the present invention provides a drinking water bucket 1, which comprises at least one base 2, at least one base plate 7, and at least one bucket structure 8. The base 2 comprises a first transverse plate 3, a second transverse plate 4, a first longitudinal plate 5 and a second longitudinal plate 6.

Two opposite ends of the first longitudinal plate 5 are respectively connected to one end of the first transverse plate 3 and one end of the second transverse plate 4. Further, one end of the first transverse plate 3, which is connected to the first longitudinal plate 5 and one end of the second transverse plate 4, which is connected to the first longitudinal plate 5 are located at the same side. Two opposite ends of the second longitudinal plate 6 are respectively connected to the other end of the first transverse plate 3 and the other end of the second transverse plate 4. Moreover, the other end of the first transverse plate 3, which is connected to the second longitudinal plate 6 and the other end of the second transverse plate 4, which is connected to the second longitudinal plate 6 are located at the same side. The first longitudinal plate 5 is located above the first transverse plate 3 and the second transverse plate 4, and the second longitudinal plate 6 is also located above the first transverse plate 3 and the second transverse plate 4.

The first longitudinal plate 5 comprises a first sliding groove 50 which is disposed at one side of the first longitudinal plate 5, which is connected to the first transverse plate 3 and the second transverse plate 4, and a first groove 53 which is disposed at one side of the first longitudinal plate 5, faces to the second longitudinal plate 6 and adjoins to the first sliding groove 50. Each of the two opposite sides of the first sliding groove 50 comprises a first clamping edge 51 which extends vertically inwards and is parallel to the first transverse plate 3 and the second transverse plate 4, and a first sliding channel 52 which is communicated with an inside space of the first sliding groove 50 is formed between the first clamping edges 51.

The second longitudinal plate 6 comprises a second sliding groove 60 which is disposed at one side of the second longitudinal plate 6, which is connected to the first transverse plate 3 and the second transverse plate 4, and a second groove 63 which is disposed at one side of the second longitudinal plate 6, faces to the first longitudinal plate 5 and is opposite to the first groove 53, wherein the second groove 63 adjoins to the second sliding groove 60. Each of the two opposite sides of the second sliding groove 60 comprises a second clamping edge 61 which extends vertically inwards and is parallel to the first transverse plate 3 and the second transverse plate 4, and a second sliding channel 62 which is communicated with an inside space of the second sliding groove 60 is formed between the second clamping edges 61.

A first left transverse moving portion 30 which is capable of moving in the first sliding groove 50 is disposed at one side of the first transverse plate 3, which is connected to the first longitudinal plate 5. The first left transverse moving portion 30 comprises a first left transverse rod body 300 which is connected to one side of the first transverse plate 3 and capable of sliding in the first sliding channel 52, and a first left transverse raised wall 301 which is connected to one end of the first left transverse rod body 300 away from the first transverse plate 3, is accommodated in an inside space of the first sliding groove 50 and abuts against one side of each of the first clamping edges 51 away from the first transverse plate 3.

A first right transverse moving portion 31 which is capable of moving in the second sliding groove 60 is disposed at one side of the first transverse plate 3, which is connected to the second longitudinal plate 6. The first right transverse moving portion 31 comprises a first right transverse rod body 310 which is connected to one side of the first transverse plate 3 and capable of sliding in the second sliding channel 62, and a first right transverse raised wall 311 which is connected to one end of the first right transverse rod body 310 away from the first transverse plate 3, is accommodated in an inside space of the second sliding groove 60 and abuts against one side of each of the second clamping edges 61 away from the second transverse plate 4.

A second left transverse moving portion 40 which is capable of moving in the first sliding groove 50 is disposed at one side of the second transverse plate 4, which is connected to the first longitudinal plate 5. The second left transverse moving portion 40 comprises a second left transverse rod body 400 which is connected to one side of the second transverse plate 4 and capable of sliding in the first sliding channel 52, and a second left transverse raised wall 401 which is connected to one end of the second left transverse rod body 400 away from the second transverse plate 4, is accommodated in the inside space of the first sliding groove 50 and abuts against one side of each of the first clamping edges 51 away from the second transverse plate 4.

A second right transverse moving portion 41 which is capable of moving in the second sliding groove 60 is disposed at one side of the second transverse plate 4, which is connected to the second longitudinal plate 6. The second right transverse moving portion 41 comprises a second right transverse rod body 410 which is connected to one side of the second transverse plate 4 and capable of sliding in the second sliding channel 62, and a second right transverse raised wall 411 which is connected to one end of the second right transverse rod body 410 away from the second transverse plate 4, is accommodated in the inside space of the second sliding groove 60 and abuts against one side of each of the second clamping edges 61 away from the second transverse plate 4.

The base plate 7 is located between the first longitudinal plate 5 and the second longitudinal plate 6. Two opposite sides of the base plate 7 are respectively connected to one side of the first longitudinal plate 5 and one side of the second longitudinal plate 6, and are respectively clamped at the first groove 53 and the second groove 63. The base plate 7 comprises a placement hole 70 which is formed in the base plate 7 and penetrates through the base plate 7.

The bucket structure 8 comprises a bucket 80, a cover body 81 and a pipe 82, wherein the bucket 80 comprises an accommodating space 800, which is arranged inside the bucket 80, a convex portion 801 which is disposed at one end of the bucket 80 and extends into the placement hole 70, and an opening 802 which is formed in one end of the convex portion 801 and communicated with the accommodating space 800. The cover body 81 covers the opening 802, and comprises a through hole 810 which penetrates through the cover body 81, and a water outlet hole 811 which penetrates through the cover body 81, adjoins to the through hole 810 and is communicated with the accommodating space 800. The pipe 82 extends into the through hole 810, wherein one end of the pipe 82 is accommodated in the accommodating space 800, and the other end of the pipe 82 is located outside the cover body 81.

In the present embodiment, the first left transverse moving portion 30, the first right transverse moving portion 31, the second left transverse moving portion 40 and the second right transverse moving portion 41 are all described with screws as applications; however, only the rod body portions and the raised walls are essential in the present invention. Therefore, the embodiments enumerated by the present invention are not intended to limit the present invention.

Referring to FIG. 1, FIG. 2, FIG. 3, FIG. 4 and FIG. 5, a more detailed description of practical applications is made. A water opening/closing valve (not shown in the drawings) which is disposed at the water outlet hole 811 is further included in the practical application. First, the first transverse plate 3, the second transverse plate 4, the first longitudinal plate 5 and the second longitudinal plate 6 are connected respectively with the first left transverse moving portion 30, the first right transverse moving portion 31, the second left transverse moving portion 40, the second right transverse moving portion 41, the first sliding groove 50 and the second sliding groove 60. Later, the base plate 7 is clamped at the first groove 53 and the second groove 63, the convex portion 801 of the bucket 80 is fixed in the placement hole 70 in a penetrating manner, and the pipe 82 extends into the through hole 810, and two ends of the pipe 82 are respectively located in the accommodating space 800 and in the air outside the cover body 81. Next, the water opening/closing valve is opened to allow water in the bucket 80 to flow into a teapot, a cup or other container for the user to drink.

Continuing with the above, in the present invention, since two ends of the pipe 82 are respectively located in the accommodating space 800 and in the air outside the cover body 81, when the user opens the water opening/closing valve to allow water in the bucket 80 to flow into the teacup, external air will flow into the accommodating space 800 of the bucket 80 via the pipe 82, such that the amount of the external air flowing from the water outlet hole 811 to water is relatively less. In this way, the sound caused by bubbles can be eliminated to reduce the interference to people in the surrounding environment. In addition, because two ends of the pipe 82 are respectively located in the accommodating space 800 and in the air outside the cover body 81, when a user opens the water opening/closing valve and water in the bucket 80 flows into a teacup. Therefore, water in the bucket 80 can flow into the teacup evenly, which is different from the prior art in which water flows out unevenly.

Figure 6:
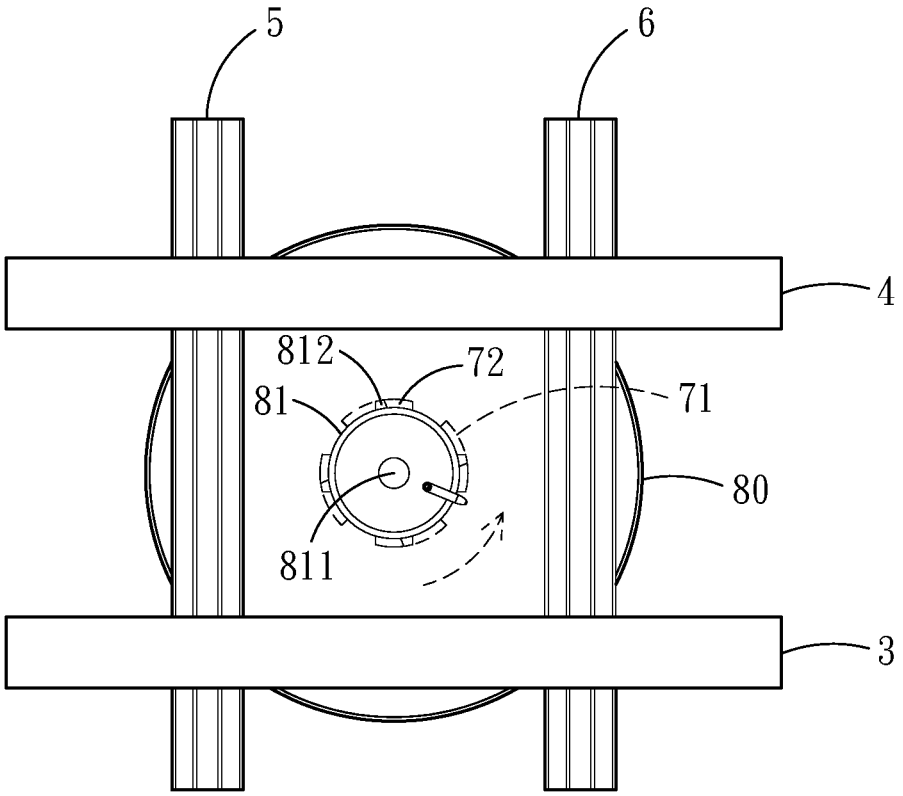
FIG. 6 is an action schematic diagram (I) of a first state between a clamping block and a clamping groove in the drinking water bucket of the present invention.
Figure 7:
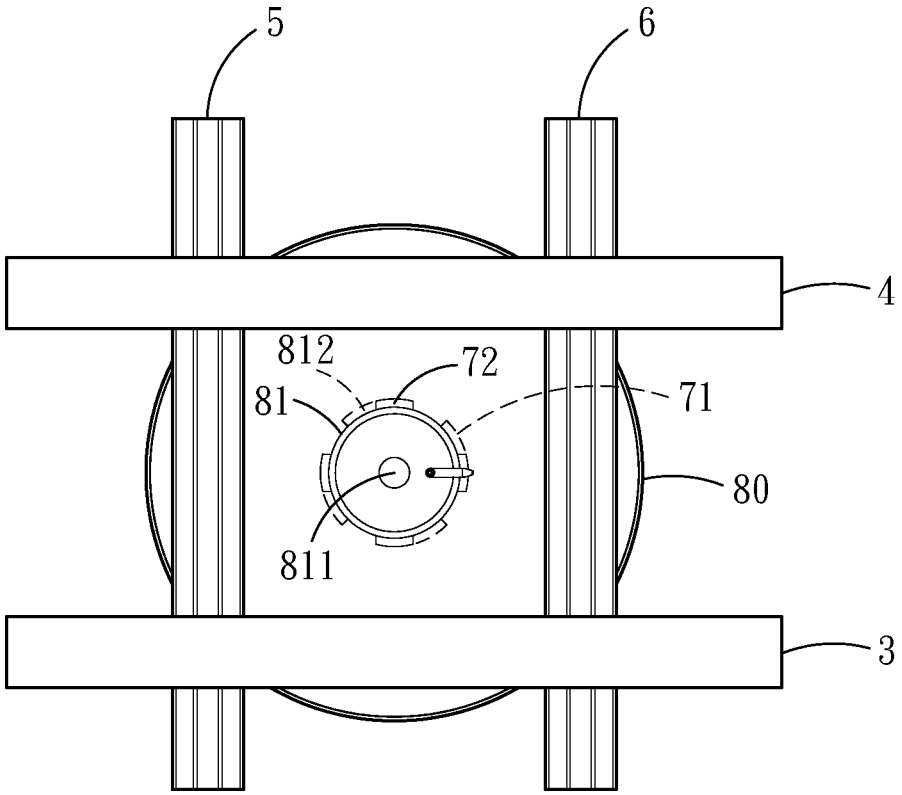
FIG. 7 is an action schematic diagram (II) of a second state between the clamping block and the clamping groove in the drinking water bucket of the present invention.

Further, referring to FIG. 1, FIG. 2, FIG. 3, FIG. 4 and FIG. 5 again in combination with FIG. 6 and FIG. 7, the base plate 7 comprises a clamping groove 71 which is formed in the inside wall end of the placement hole 70. The cover body 81 comprises a clamping block 812 which is disposed around the outer side of the cover body 81, extends outwards and is correspondingly matched with the clamping groove 71. The cover body 81 is positioned in the placement hole 70 by clamping the clamping block 812 in the clamping groove 71, and the bucket 80 is positioned on the base plate 7. Even in an embodiment, the base plate 7 comprises a stretching space 72 which is disposed at one side of the placement hole 70 and correspondingly matched with the shape of the clamping block 812, such that the clamping block 812 is placed in the clamping groove 71 via the stretching space 72, and the convex portion 801 is positioned in the placement hole 70 by rotating the clamping block 812 in the clamping groove 71. Furthermore, the width of the clamping groove 71 may be set as required in a manner of progressively decreasing towards one end. When the clamping block 812 rotates in the clamping groove 71, the clamping block 812 can be stably clamped in the clamping groove 71 because the width of the groove decreases progressively.

Although the clamping block 812 in the present embodiment is described in a manner of being disposed around the outer side of the cover body 81, in practical embodiments, the clamping block 812 may also be disposed around the outer side of the convex portion 801, and the bucket 80 is also allowed to be positioned on the base plate 7.

Further, referring to FIG. 1, FIG. 2, FIG. 3, FIG. 4, FIG. 5, FIG. 6 and FIG. 7 again, since the first longitudinal plate 5 and the second longitudinal plate 6 in the present invention are respectively connected to the first transverse plate 3 and the second transverse plate 4 via the first sliding groove 50 and the second sliding groove 60, and the connecting ends thereof are technically characterized by a pivotal connection manner, when the drinking water bucket 1 is not used, the user may remove the base plate 7 and then folds the first transverse plate 3, the second transverse plate 4, the first longitudinal plate 5 and the second longitudinal plate 6 directly and store the same conveniently.

Figure 8:
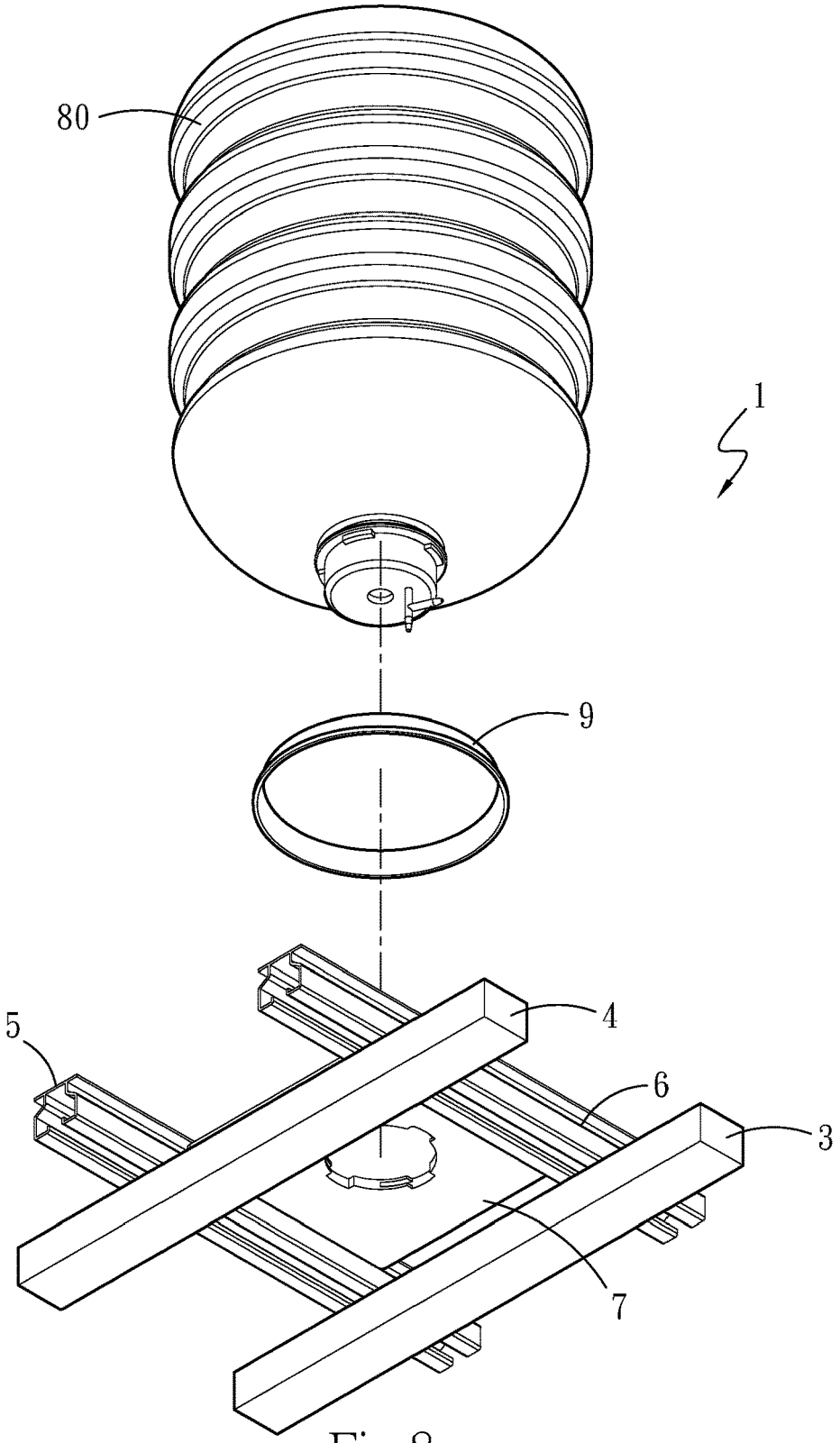
FIG. 8 is a perspective exploded view of an embodiment in which the drinking water bucket of the present invention comprises a kit.
Figure 9:
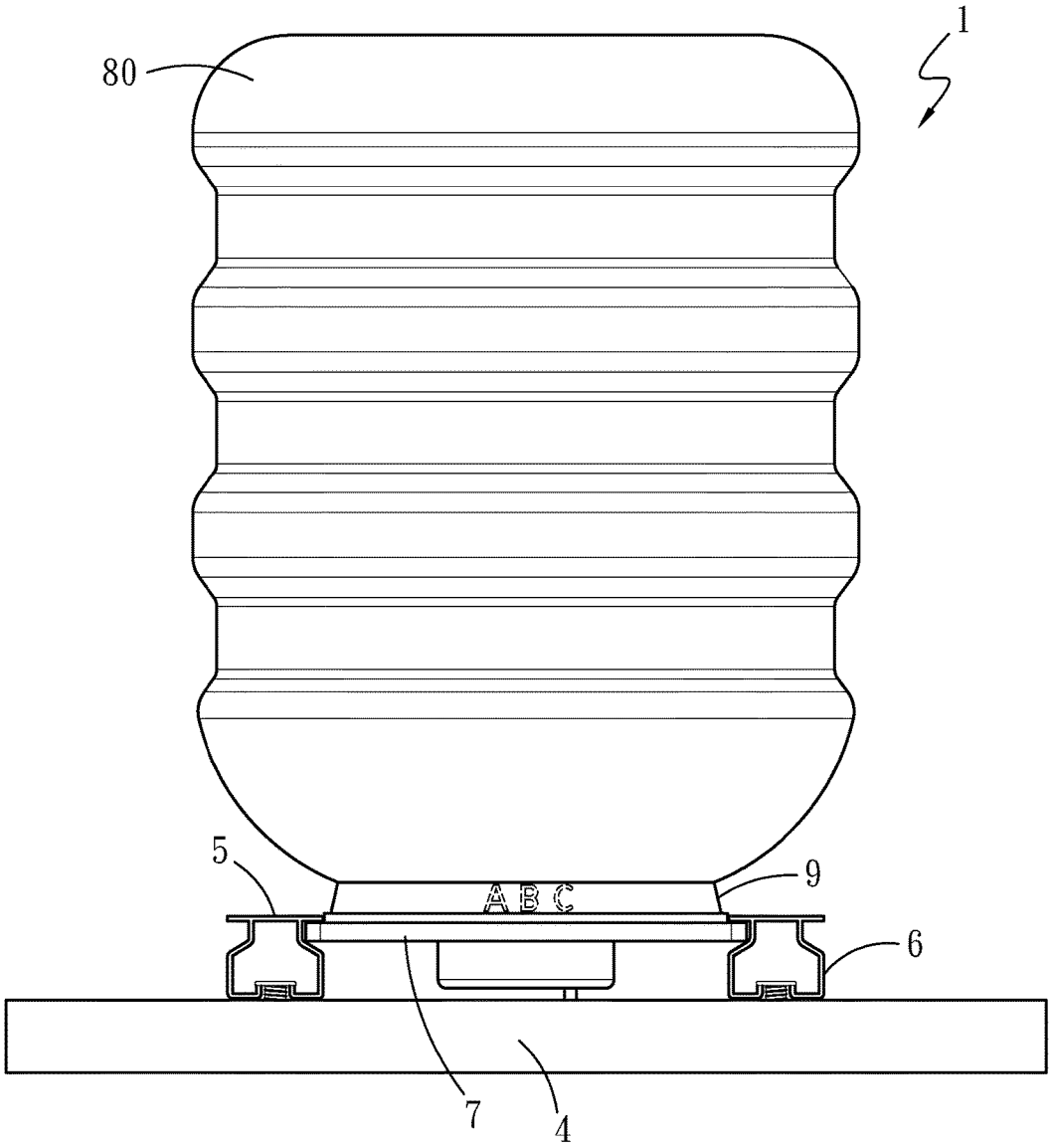
FIG. 9 is a planar assembly view of FIG. 8.

Moreover, referring to FIG. 8 and FIG. 9, the drinking water bucket 1 further comprises a kit 9 which is hollow and disposed around the cover body 81 and the convex portion 801. The kit 9 is disposed between the base plate 7 and the bucket 80, and one end of the kit 9 away from the base plate 7 abuts against the peripheral wall end of the bucket 80, such that the bucket 80 can be further positioned on the base plate 7 more stably. In addition, the periphery of the kit 9 can also be printed with trademarks, or patterns, or advertising and other marketing tools, such that the drinking water bucket 1 quickly becomes known to the general public and promotes economic development.

Figure 10:
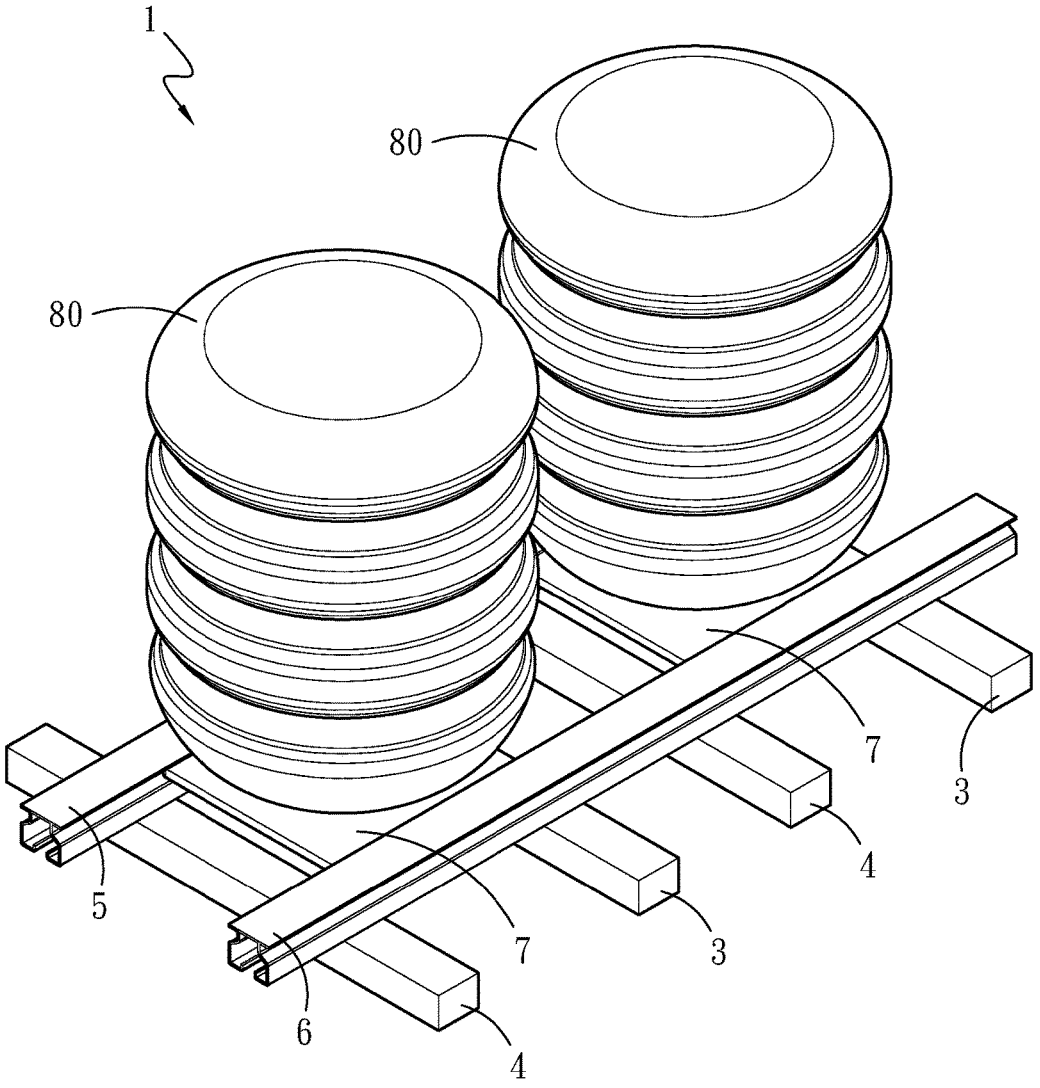
FIG. 10 is a perspective assembly view of a plurality of bucket structures of the drinking water bucket of the present invention.
Figure 11:
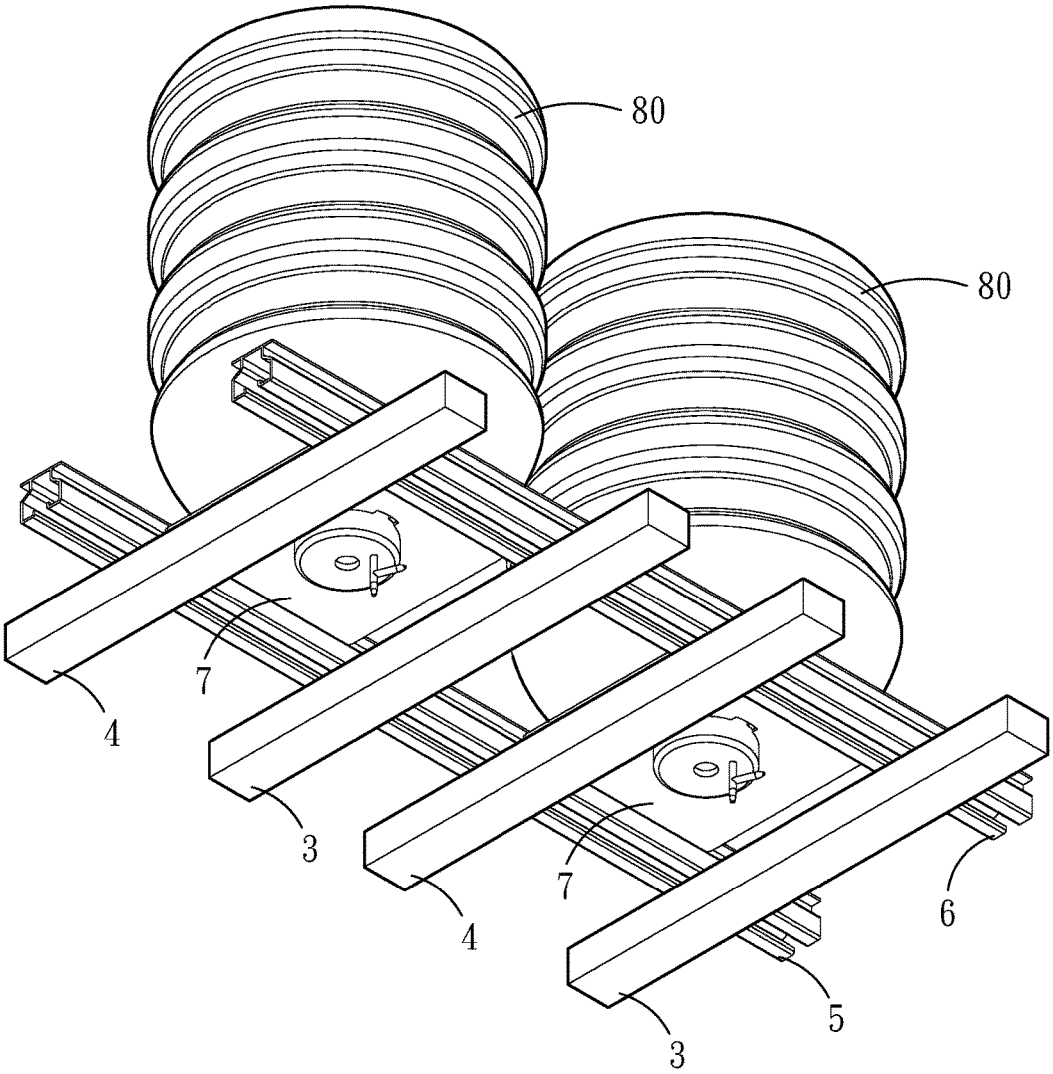
FIG. 11 is a top view of FIG. 10.

Referring to FIG. 10 and FIG. 11, in the present embodiment, the first transverse plate 3, the second transverse plate 4, the base plate 7 and the bucket structure 8 of the drinking water bucket 1 are respectively described in two forms, but will not be limited thereto. Or at least one extension pipe 83 is connected to one end of the pipe 82, which is located outside the cover body 81 as required, and the extension pipe 83 is used for being connected to at least one of another pipe 82 in another bucket structure 8, such that more drinkers may be dispersed to other bucket structures 8, rather than concentrating to the front of the same bucket structure 8 to cause space congestion.

The present invention has the following characteristics.

1. Two ends of the pipe 82 are respectively located in the accommodating space 800 and in the air outside the cover body 81. Therefore, when a user opens the water opening/closing valve and water in the bucket 80 flows into a teacup, the sound caused by bubbles generated from air flowing back into water can be eliminated to reduce the interference to people in the surrounding environment.

2. Also because two ends of the pipe 82 are respectively located in the accommodating space 800 and in the air outside the cover body 81, when a user opens the water opening/closing valve and water in the bucket 80 flows into a teacup. Therefore, water in the bucket 80 can flow into the teacup evenly, which is different from the prior art in which water flows out unevenly.

3. Due to the arrangement of the extension pipe 83, the user can increase another bucket structure 8 or a plurality of bucket structures 8. Therefore, more drinkers may be dispersed to other bucket structures 8, rather than concentrating to the front of the same bucket structure 8 to cause space congestion.

4. The through hole 810 and the pipe 82 are disposed beside the water outlet hole 811. Therefore, the space and the channel through which air flows are increased, and the amount of air flowing to the water in the bucket 80 from the water outlet hole 811 is reduced. Therefore, not only the objective of this application is achieved, but also the technical features thereof can be further taken as teaching materials to teach people.

What is claimed is:

1. A drinking water bucket, comprising:

at least one base, wherein the base comprises a first transverse plate, a second transverse plate, a first longitudinal plate and a second longitudinal plate, wherein two opposite ends of the first longitudinal plate are respectively connected to one end of the first transverse plate and one end of the second transverse plate, and one end of the first transverse plate, which is connected to the first longitudinal plate and one end of the second transverse plate which is connected to the first longitudinal plate are located on the same side; two opposite ends of the second longitudinal plate are respectively connected to the other end of the first transverse plate and the other end of the second transverse plate, and the other end of the first transverse plate, which is connected to the second longitudinal plate and the other end of the second transverse plate, which is connected to the second longitudinal plate are located on the same side;

at least one base plate, wherein two opposite sides of the base plate are respectively connected to one side of the first longitudinal plate and one side of the second longitudinal plate, and the base plate is located between the first longitudinal plate and the second longitudinal plate, wherein the base plate comprises a placement hole which is formed in the base plate and penetrates through the base plate; and at least one bucket structure, wherein the bucket structure comprises a bucket, a cover body and a pipe, wherein the bucket comprises an accommodating space arranged inside the bucket, a convex portion which is disposed at one end of the bucket and extends into the placement hole, and an opening which is formed in one end of the convex portion and communicated with the accommodating space; the cover body covers the opening, and comprises a through hole which penetrates through the cover body, and a water outlet hole which penetrates through the cover body, adjoins to the through hole and is communicated with the accommodating space; the pipe extends into the through hole, wherein one end of the pipe is accommodated in the accommodating space, and the other end of the pipe is located outside of the cover body.

2. The drinking water bucket according to claim 1, wherein a first sliding groove is formed in one side of the first longitudinal plate, which is connected to the first transverse plate and the second transverse plate, and a second sliding groove is formed in one side of the second longitudinal plate connected to the first transverse plate and the second transverse plate; a first left transverse moving portion which is capable of moving in the first sliding groove is disposed at one side of the first transverse plate connected to the first longitudinal plate, and a first right transverse moving portion which is capable of moving in the second sliding groove is disposed at one side of the first transverse plate connected to the second longitudinal plate; a second left transverse moving portion which is capable of moving in the first sliding groove is disposed at one side of the second transverse plate connected to the first longitudinal plate, and a second right transverse moving portion which is capable of moving in the second sliding groove is disposed at one side of the second transverse plate connected to the second longitudinal plate.

3. The drinking water bucket according to claim 2, wherein each of the two opposite sides of the first sliding groove comprises a first clamping edge which extends vertically inwards, and a first sliding channel which is communicated with an inside space of the first sliding groove is formed between the first clamping edges; each of the two opposite sides of the second sliding groove comprises a second clamping edge which extends vertically inwards, and a second sliding channel which is communicated with an inside space of the second sliding groove is formed between the second clamping edges; the first left transverse moving portion comprises a first left transverse rod body which is connected to one side of the first transverse plate and capable of sliding in the first sliding channel, and a first left transverse raised wall which is connected to one end of the first left transverse rod body away from the first transverse plate, is accommodated in an inside space of the first sliding groove and abuts against one side of each of the first clamping edges away from the first transverse plate; the first right transverse moving portion comprises a first right transverse rod body which is connected to one side of the first transverse plate and capable of sliding in the second sliding channel, and a first right transverse raised wall which is connected to one end of the first right transverse rod body away from the first transverse plate, is accommodated in the inside space of the second sliding channel and abuts against one side of each of the second clamping edges away from the second transverse plate; the second left transverse moving portion comprises a second left transverse rod body which is connected to one side of the second transverse plate and capable of sliding in the first sliding channel, and a second left transverse raised wall which is connected to one end of the second left transverse rod body away from the second transverse plate, is accommodated in an inside space of the first sliding channel and abuts against one side of each of the first clamping edges away from the second transverse plate; the second right transverse moving portion comprises a second right transverse rod body which is connected to one side of the second transverse plate and capable of sliding in the second sliding channel, and a second right transverse raised wall which is connected to one end of the second right transverse rod body away from the second transverse plate, is accommodated in the inside space of the second sliding channel and abuts against one side of each of the second clamping edges away from the second transverse plate.

4. The drinking water bucket according to claim 1, wherein the first longitudinal plate comprises a first groove which is disposed at one side and faces to the second longitudinal plate; the second longitudinal plate comprises a second groove which is disposed at one side, faces to the first longitudinal plate and is opposite to the first groove; two opposite sides of the base plate are respectively clamped at the first groove and the second groove.

5. The drinking water bucket according to claim 1, wherein at least one extension pipe is connected to one end of the pipe outside the cover body and used for being connected to at least one of another pipe in another bucket structure.

6. The drinking water bucket according to claim 1, further comprising a kit which is disposed around the cover body and the convex portion and located between the base plate and the bucket.

7. The drinking water bucket according to claim 1, further comprising a water opening/closing valve disposed at the water outlet hole.

8. The drinking water bucket according to claim 1, wherein the base plate comprises a clamping groove which is disposed at the inside wall end of the placement hole; the cover body comprises a clamping block which is disposed around the outer side of the cover body, extends outwards and is correspondingly matched with the clamping groove.

9. The drinking water bucket according to claim 8, wherein the width of the clamping groove progressively decreases towards one end.

10. The drinking water bucket according to claim 8, wherein the base plate comprises a stretching space which is disposed at one side of the placement hole and correspondingly matched with the shape of the clamping block, such that the clamping block is placed in the clamping groove via the stretching space, and the cover body is positioned in the placement hole by rotating the clamping block in the clamping groove.

* * * * *